United States Patent [19]

Greco

[11] 4,082,337

[45] Apr. 4, 1978

[54] DOOR SECURING DEVICE

[76] Inventor: John J. Greco, 713 E. Sahara, Las Vegas, Nev. 89105

[21] Appl. No.: 686,105

[22] Filed: May 13, 1976

[51] Int. Cl.[2] ..... E05C 17/44

[52] U.S. Cl. ..... 292/338; 292/DIG. 15; 292/238

[58] Field of Search ..... 292/238, DIG. 15, 338, 292/210, 339; 16/82; 70/94

[56] References Cited

U.S. PATENT DOCUMENTS

| | | | |
|---|---|---|---|
| 185,043 | 12/1876 | Osborn | 292/DIG. 15 |
| 1,185,547 | 5/1916 | Rugar | 292/338 |
| 1,584,637 | 5/1926 | Negviller | 292/338 |
| 3,341,240 | 9/1967 | Hazard | 292/338 |
| 3,913,171 | 10/1973 | Reid | 16/82 |

*Primary Examiner*—Kenneth J. Dorner

[57] ABSTRACT

A door securing device comprising a combination of conventional hardware items which, when combined, produce a convenient assembly. The standard items include a hinge securable by one element to either the door frame or the door itself according to the opening direction of the door and a conduit hanger attached to the secured element of the hinge. A plurality of threaded bolts inserted in the other hinge element form the latching detent. The conduit hanger can then be positioned to either oppose the unlatching motion of the free hinge element, retain the hinge in unlatched state or totally out of the way to thereby permit self-latching engagement.

1 Claim, 4 Drawing Figures

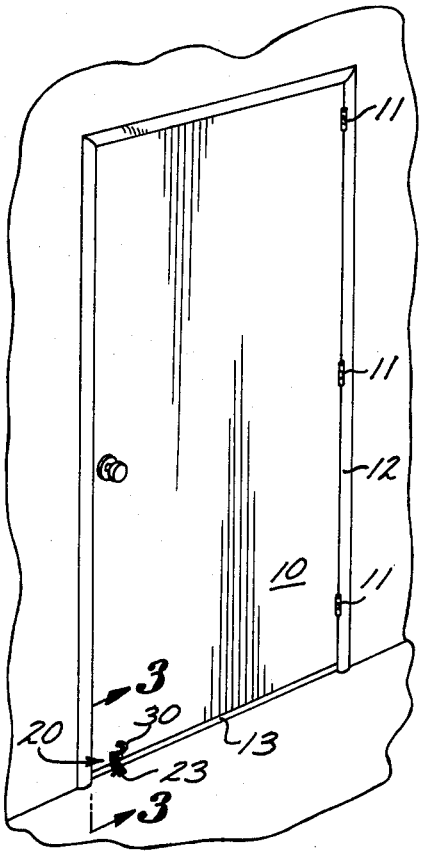
FIG. 1
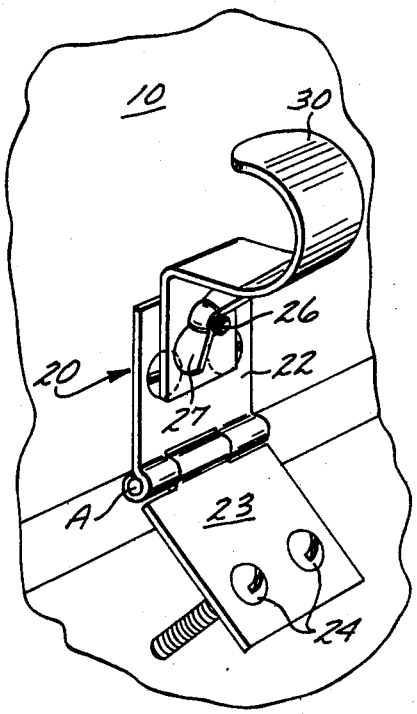
FIG. 2
FIG. 3
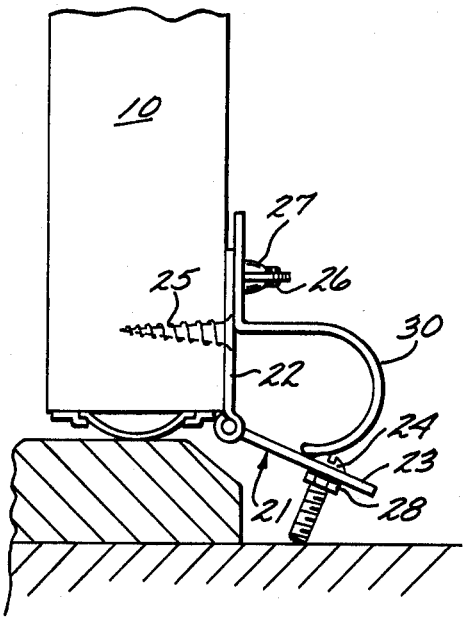
FIG. 4
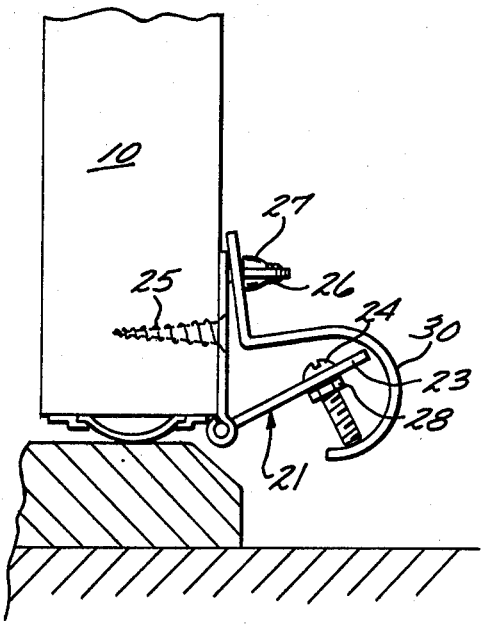

DOOR SECURING DEVICE

BACKGROUND OF THE INVENTION

1. Field of the Invention

The present invention relates to door latching devices, and more particularly to an adaptable door lock comprising conventional parts.

2. Description of the Prior Art

As crime against property continually increases devices for securing access to a home appear with increasing frequency on the market shelf. In each instance most such prior art devices are specially made according to special tooling and therefore are necessarily high in cost. Even the most conventional sliding bolt assembly requires expensive tools which therefore limit the number of new entrants into such a product line with the attendant or resulting high costs because of the lack of wide competition. Consequently the most frequent instances of active price competition occur in devices having minimal investment in tooling which heretofore were of inherently lower quality, less flexible and therefore were less reliable in use.

Furthermore most cost savings have been heretofore achieved by utilizing standard stock like bar stock or extrusion from which a particular latching device was fabricated. Equally common with bar stock are various other hardware implements which until this time have not been utilized in a latch assembly.

SUMMARY OF THE INVENTION

Accordingly it is the general purpose and object of the present invention to provide a highly adaptable latching device which is wholly assembled of standard hardware components.

Yet another object of the present invention is to provide a latching device in kit form which is fully adaptable to most desired uses and which furthermore requires the most minimal skills in installation.

Briefly these and other objects are accomplished within the present invention by combining a conventional hinge with a conventional conduit hanger into an assembly forming a latch which can be either disposed in an unlatched position, in a fully secured position, or in a self-latching arrangement. More specifically a conventional hinge can be secured by one pivotal end thereof to the articulated jamb or segment of a door with the other end freely suspended therefrom. The normally included screw holes in this freely suspended hinge portion can then be used to receive corresponding bolts which are secured in an engaging position by corresponding nuts on the other side. By aligning this arrangement of parts along the edge of the door, the projecting end of the secured bolts then provide engagement with the fixed structure surrounding the door. thus if it is desired to secure the door against inadvertent opening the normal gravitational forces dispose the freely pivoted end of the hinge into an engaging position relative the door frame. To provide for additional flexibility in use or operation it is further contemplated to include a conventional conduit hanger bracket in the kit, such conduit bracket being adapted to be selectively secured to the fixed end of the hinge. By selective securing the conduit bracket can be either rotated downwardly to oppose the disengagement motion of the free end of the hinge, can be used furthermore to support the hinge in an unlatched alignment, or can be simply rotated out of the way to provide a self-latching configuration.

This combination of parts comprises conventionally used hardware items, and therefore requires no investment in tooling or manufacture other than the simple selection of proper sizes. This collection can then be sold or vended in a kit form with the requisite instructions where the steps required the instruction sequence are steps commonly performed by a home mechanic.

BRIEF DESCRIPTION OF THE DRAWINGS

FIG. 1 is a perspective illustration of an externally opening doorway having the inventive assembly mounted thereon;

FIG. 2 is a perspective illustration, in detail, of the inventive closure assembly articulated to a self-latching configuration;

FIG. 3 is a side view taken along line 33 of FIG. 2 arranged for a fully secured closure; and FIG. 4 is the same view as in FIG. 3 with the assembly articulated to a fully unlatched arrangement.

DESCRIPTION OF THE PREFERRED EMBODIMENT

While the present illustration sets forth the use of the inventive latching assembly in conjunction with an externally opening doorway, such use is exemplary only. It is to be noted that by selective disposition along the door jamb, for example, a similar securing configuration can be achieved in an internally articulating doorway. Accordingly the examples presented are in conjunction with one desired application, the various other uses thereof being clearly obvious to those skilled in the art.

As shown in FIG. 1 a conventional door assembly 10 is suspended by way of a plurality of hinges 11 from a door frame 12. In this arrangement the door 10 is free to pivot over a door sill 13. Disposed along the lower edge of the door assembly 10 and in position to engage the door sill 13 is a latching assembly 20 constructed according to the present invention.

As shown in FIGS. 2, 3, and 4 assembly 20 comprises a hinge 21 secured by one pivotal end 22 to the door 10 with the hinge axis A thereof aligned adjacent the lower edge of the door. In this arrangement the other pivotal element of the hinge shown herein as element 23 is suspended from the hinge axis A to extend over the lateral edge of the door sill. Inserted into the screw holes of element 23 are two bolts 24 secured on the other side by nuts 28 with the threaded ends thereof directed towards the sill 13 to thus affect a latching engagement.

By further reference to FIGS. 2, 3, and 4 the fixed hinge element 22 is secured to the lower door edge by way of the conventional securing screws 25 extending through two of the securing screw holes while the third one it utilized to receive a threaded stud 26. Mounted on stud 26 and secured thereto by a wing nut 27 is a conventional conduit hanger 30 which in FIG. 2 is articulated away from the element 23. This hanger 30 can be turned downwardly about stud 26 to oppose the upward articulation of element 23. This particular alignment is shown in FIG. 3. In the alternative hanger 30 which can be utilized to support the free end of element 23 out of an engagement position to thus permit free articulation of the door. Again this engagement is shown in FIG. 4.

By this combination of parts a relatively convenient securing assembly is formed. While the foregoing description illustrated a latching arrangement which would secure the door 10 from exteriorly opening various other directions of opening can be accommodated. For example, by locating the assembly 20 on the top horizontal runner of the door frame 12 it is possible to secure that same door against inadvertent interior opening. In each instance it is the conventional parts or hardware items that are used in this invention and therefore no tooling is necessary. It is only necesssary to select the proper sizes of the hinge 21 and the hanger 20 in order to assure a cooperative function.

Obviously many modifications and variations to the above disclosure can be made without departing from the spirit of the invention. It is therefore intended that the scope of the invention be determined solely dependent on the claims hereto.

I claim:

1. A door securing device comprising an assemblage of standard hardware items, in combination:

a hinge comprising a first and second element pivotally connected in common adapted to be secured by said first element thereof to a selected area of said door;

a conduit hanger adapted to be pivotally secured over said first element of said hinge for selective disposition relative said second element of said hinge;

said conduit hanger includes a planar segment pivotally secured over said first element and a convoluted segment extending from one edge of said planar segment, said convoluted segment being conformed to receive said second element of said hinge in a first mode and to oppose said second element in a second mode, a wing nut mounted proximate said first element of said hinge for selective securing of said conduit hanger;

a plurality of threaded bolt assemblies secured to orthogonally extend in engaging alignment from said second element.

* * * * *